US005913434A

United States Patent [19]

Fukuhara et al.

[11] Patent Number: 5,913,434

[45] Date of Patent: Jun. 22, 1999

[54] RETORTABLE CONTAINER

[75] Inventors: Akio Fukuhara, Kanagawa; Tsuyoshi Yoshioka, Hachiouji; Yukihiro Takao, Ibaraki, all of Japan

[73] Assignees: Otsuka Pharamaceutaical Co., Ltd.; Daiwa Can Company, both of Toyko, Japan

[21] Appl. No.: 08/890,298

[22] Filed: Jul. 9, 1997

[30] Foreign Application Priority Data

Jul. 10, 1996 [JP] Japan ..... 8-199796

[51] Int. Cl.[6] ..... B65B 7/28; B65D 41/16

[52] U.S. Cl. ..... 215/44; 215/321; 215/330; 215/344

[58] Field of Search ..... 215/307, 321, 215/330, 344, 346, 44, 45; 220/367.1, 730, 731

[56] References Cited

U.S. PATENT DOCUMENTS

| | | | |
|---|---|---|---|
| 2,298,777 | 10/1942 | Thomas | 215/330 X |
| 3,794,200 | 2/1974 | Marks . | |
| 4,378,894 | 4/1983 | Willis et al. . | |
| 4,387,821 | 6/1983 | Geiger . | |
| 4,519,513 | 5/1985 | Weiler et al. . | |
| 4,646,949 | 3/1987 | Stull | 222/521 |
| 4,852,774 | 8/1989 | Crawford . | |
| 4,989,744 | 2/1991 | Tominaga | 220/367.1 |
| 5,143,234 | 9/1992 | Lohrman et al. . | |
| 5,469,980 | 11/1995 | O'Meara et al. | 215/228 |
| 5,722,545 | 3/1998 | Rinne | 215/44 |

FOREIGN PATENT DOCUMENTS

| | | |
|---|---|---|
| 0 267 748 | 5/1988 | European Pat. Off. . |
| 92 12 026 U | 2/1993 | Germany . |
| 55-117952 | 2/1980 | Japan . |
| 56-106753 | 8/1981 | Japan . |
| 2 166 422 | 5/1986 | United Kingdom . |
| WO 91/03404 | 3/1991 | WIPO . |

*Primary Examiner*—Stephen K. Cronin
*Attorney, Agent, or Firm*—Finnegan, Henderson, Farabow, Garrett & Dunner, L.L.P.

[57] ABSTRACT

The present invention provides a retortable container which has an engagement ridge (19), of an outer diameter $D_1$ smaller than an inner diameter $D_2$ of a thread of a cap (20), formed on the outer circumference of the neck (13) near the top face thereof and an engagement portion (26) having an engaging hook (26*a*), capable of engaging with the engagement ridge (19) of the neck (13) under the condition that engagement of the neck (13) and the cap (20) is completed, being formed integrally therewith on the bottom surface of the top wall (21) of the cap (20), whereas the engagement portion (26) is formed in a shape of cylinder having a wall thickness smaller than the wall thickness of the circumferential wall (28) of the cap (20), and the engaging hook (26*a*) protrudes in an annular shape inwardly from the open bottom end of the engagement portion (26). This configuration of the container is capable of preventing the cap (20) from coming off and the screw engagement of the container body and the cap (20) from loosening during sterilization process, and allows it to detach the cap (20) with less force (FIG. 2).

7 Claims, 4 Drawing Sheets

RETORTABLE CONTAINER

TECHNICAL FIELD

The present invention relates to a container for such products as foods which are thermally sterilized by heating in a retort chamber after they are packed and sealed in the container.

BACKGROUND ART

There are containers that are, after being filled with a food product and sealed, put into a retort chamber for thermal sterilization at a temperature above 100° C. (for about 20 minutes at 127° C. for example). As one of such containers, a collapsible tube container comprising a container body and a cap, both made of the thermoplastic materials, has been known (see Japanese Patent Kokai (A) Publication No. 56-106753 (1981)).

The aforementioned collapsible tube container has an aperture at the top end of a neck, which is sealed with a thin film including aluminum foil, and an open bottom end. This container is used in such manner that, after a cap is screwed onto the neck, the tube container is placed up side down and filled with a food product in the form of paste through the open bottom end. After the bottom end is pressed flat and heat-sealed, the tube container is put into a retort chamber and is subjected to thermal sterilization.

Such collapsible tube containers each comprising the container body and the cap which are made of thermoplastic materials and engaged with each other in threadable arrangements easily deform as the container body and the cap are softened by heat during the thermal sterilization process in the retort chamber. Also, in the retort chamber, the containers are subjected to fluidal pressure from sprays of hot water and cooling water as well as from the product which is agitated for the purpose of accelerating heat transfer, so that rotating force exerted to the caps about the container bodies. This causes the caps of the majority of the containers to be loosened and in the worst case, to be completely unscrewed off the container bodies.

As the aperture at the top end of the necks of the containers, is sealed with a thin film such as a heat-sealing propylene tape which includes a gas barrier layer of aluminum foil, the product may not leak out of the containers even when the caps are loosened or completely unscrewed.

However, if consumers, who are going to buy a food product in such containers, find that the caps are loosened, they may suspect that the containers have been unsealed, and lose confidence in the product. Thus loose caps are undesirable for a supplier of the products, and the supplier is often forced to retighten the caps or reset the caps which have come off the containers.

Therefore, a retortable container having a cap which may not become loose during retorting process has long been desired in the industry.

As a container employing an anti-loosening mechanism for preventing threadable engagement of its container body and its cap from loosening, there has been known a container comprising a container body 31 made of glass and having a threaded neck 32 and a screw cap 35 made of a synthetic resin for threadable engagement with the neck 32 as shown in FIG. 4 (see Japanese Utility Model Kokai (A) Publication No. 55-117952 (1980)). With this container, the neck 32 has a first engagement ridge 34 extending around the periphery at the top end in an outer diameter smaller than the inner diameter of female threads 39 of the cap, and the cap 35 has a second engagement ridge 40 provided at the upper end of the inner surface of a circumferential wall 38 in an inner diameter layer than the outer diameter of ridge 34, whereas screwing the cap 35 with sufficient force onto the neck 32 causes the second engagement ridge 40 to pass over the first engagement ridge 34 thereby engaging onto the lower surface thereof, and unscrewing the cap 35 with sufficient force causes the second engagement ridge 40 to pass over the first engagement ridge 34 upwardly.

Such conventional anti-loosening mechanism require that the second engagement ridge 40 deforms upward and at the same time the circumferential wall 38 of the cap 35 deforms outwardly, so that the second engagement ridge 40 on the cap may pass over downwardly the first engagement ridge 34 on the neck.

However, the circumferential wall 38, which is the threadable engagement portion of the cap 35, is usually formed to have a relatively thick wall in order to prevent deformation when screwed, and is consequently difficult to deform outwardly. Particularly, portions of the circumferential wall close to a top wall 37, where the second engagement ridge 40 is located, may not deform outwardly unless substantial force is exerted.

For this reason, an intensive rotating force is required to have the second engagement ridge 40 pass over the first engagement ridge 34 and, as a result, the rotating force exerted on the female threads 39 of the cap 35 during the screwing and unscrewing essentially accelerates wearing of the threads.

Further, when upper portions of the circumferential wall of the cap having the second engagement ridge 40 deform outwardly, the threaded portions of the circumferential wall below ridge 40 tend to deform greater than the second engagement ridge portions, so that repetitive screwing and unscrewing of the cap 35 causes permanent deformation of the threaded portions of the cap, resulting in undesirable looseness of the threadable engagement.

An object of the present invention is to provide a retortable container having a screw cap which may not be loosened or unscrewed completely off the container body during a retorting process.

Another object of the present invention is to provide a retortable container having a screw cap which can be mounted to and detached from the container body with a relatively small force.

A further object of the present invention is to provide a retortable container having a screw cap which allows, through openings, for reading draining water that has entered gap portions between the neck and the cap during sterilization, and for quickly getting the gap portions dry with drafts through the opening.

DISCLOSURE OF THE INVENTION

A retortable container of the present invention has an engagement ridge, of an outer diameter smaller than the inner diameter of thread of the cap, formed on the circumference of a neck near the top end thereof, and an engagement portion provided on the bottom surface of the cap top wall, which has an engaging hook capable of engaging with the engagement ridge of the neck when the cap has been screwed onto the neck.

With the retortable container according to the present invention, the cap is prevented from coming off the container body or loosened during a retorting process, thereby make it unnecessary for supplier of the container to retighten the cap before delivery and also eliminate consumers' suspicion about the product that may otherwise be caused due to loosened cap.

The aforementioned engagement portion of the cap is generally in the shape of cylinder having a wall thinner than circumferential wall, and has an annular hook portion extending radially inwardly, preferably from the bottom open end of the engagement portion.

According to this configuration, screwing and unscrewing of the cap can be done with a relatively little force and, at the same time, wear of the threads is minimized and permanent deformation of the threads is eliminated.

The top wall and the circumferential wall of the cap are connected with each other preferably via bridge portions with openings being disposed through the top wall between the bridge portions.

With the container of this configuration, water that is trapped in gap portions between the neck and the cap during a retorting process can be easily drained and the gap portions can get dry quickly by drafts through openings, so that the consumers who buy a food product in such container may not have an unfavorable feeling of insanitaion.

The engagement ridge provided on the neck is preferably formed in a plurality of discontinued ridges being arranged in line annularly along the circumference of the neck.

With the engagement ridge of this configuration, only the portions of the engagement hook portion of the cap that come in contact with the ridges are forced to deform upwardly when the cap is screwed onto the neck while the rest of the engagement hook portions passes over the engagement ridge without being deformed. Therefore, the force required for the engagement portion of the cap to pass over the engagement ridge of the neck is further reduced.

The thread provided on the neck is preferably formed on the outer circumference of the neck near the lower end thereof, while the outer circumference portion extending between the top end face of the neck and the lower portions of the outer circumference of the neck where the thread is provided is preferably formed in a shape of a truncated corn.

With this configuration, length of the thread formed on the neck of the container body can be minimized while securing adequate cap holding strength. Also the neck of the aforementioned truncated corn configuration improves the feeling of the consumers who suck the product out of the contents directly.

The thread formed on the neck and the thread formed on the wall of the cap are preferably such that a plurality of inclined ridges are arranged in an equally spaced relation in the circumferential direction, so that the cap may screwed onto the container body or removed with a minimum of turns.

The retortable container of the present invention has the top wall of the cap connected with the circumferential wall of the cap via the bridge portions, and the openings are disposed through the top wall between the bridge portions.

Accordingly, water that has been trapped in the gap portions between the neck and the cap during a retorting process can easily be drained and the gap portions can quickly get dry by drafts through the openings, so that the consumers who buy a food container product in the container may not have unfavorably feeling of insanitaion.

BEST MODE FOR CARRYING OUT THE INVENTION

Figure 1:
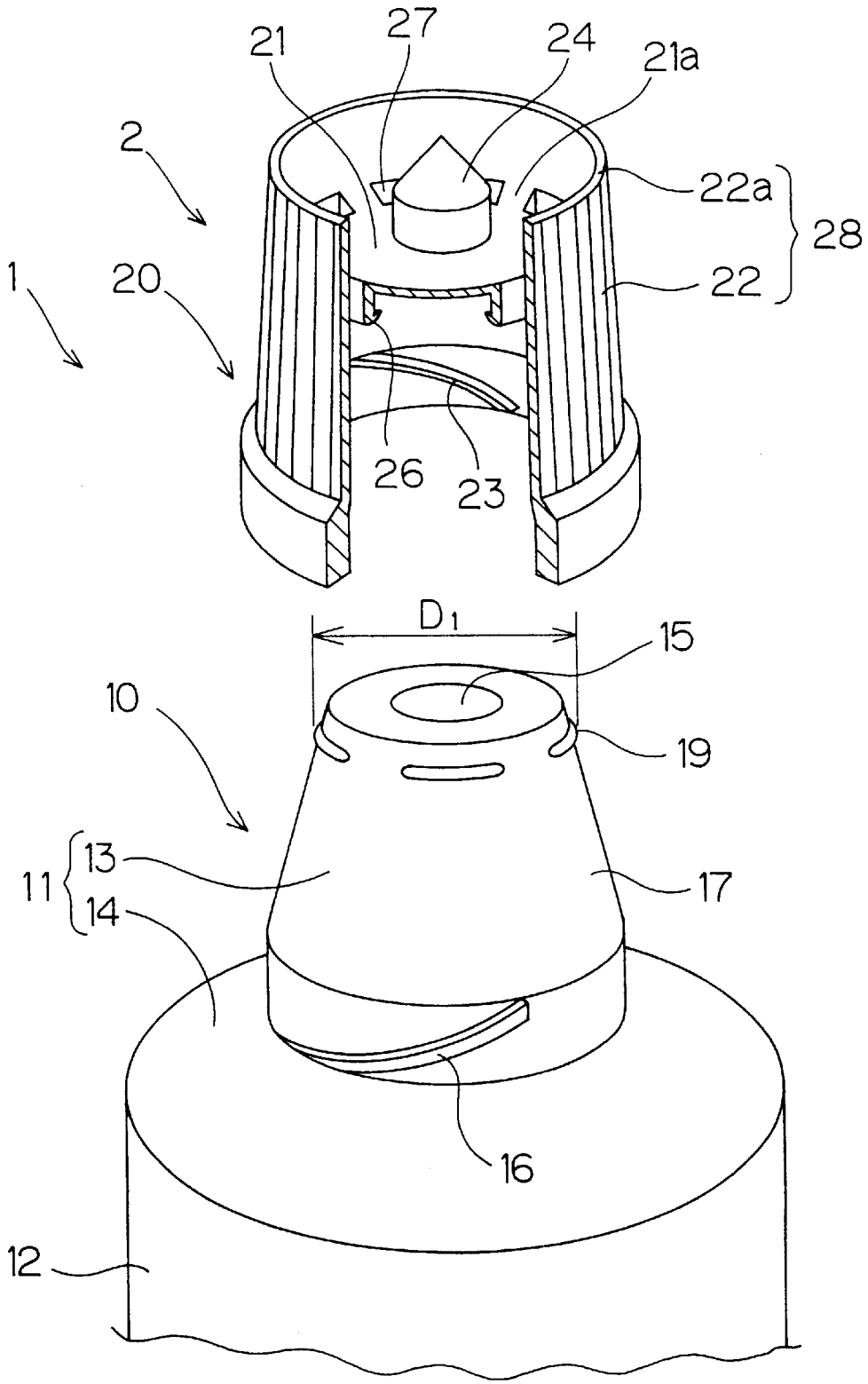
FIG. 1 is a partially cutaway oblique view showing the cap and the upper portion of the container body of the collapsible tube container according to one embodiment of the present invention.

FIG. 1 shows a preferred embodiment of the retortable container according to the present invention, in which a container body 10 of a collapsible tube container 1 comprises a head piece 11 having a neck 13 and a shoulder portion 14, both formed integrally, and a body wall portion 12 formed in the shape of a cylinder having a thin cylindrical wall. The head piece 11 and the body wall portion 12 are integrally connected with each other welding the upper end of the body wall portion 12 to the bottom end (periphery of the shoulder portion 14) of the head piece 11.

The neck 13 has a dispensing aperture 15 at the top end for dispensing a product (food). Formed on the circumferential surface of the neck 13 near the bottom end thereof are a pair of inclined ridges 16 arranged opposite to each other about the axis of the neck 13. The pair of ridges 16 may be referred to hereinafter as threads 16. Between the dispensing aperture 15 and the lower circumferential surface whereon the threads 16 are provided is an outer circumference 17 in a shape of a truncated cone.

Figure 2:
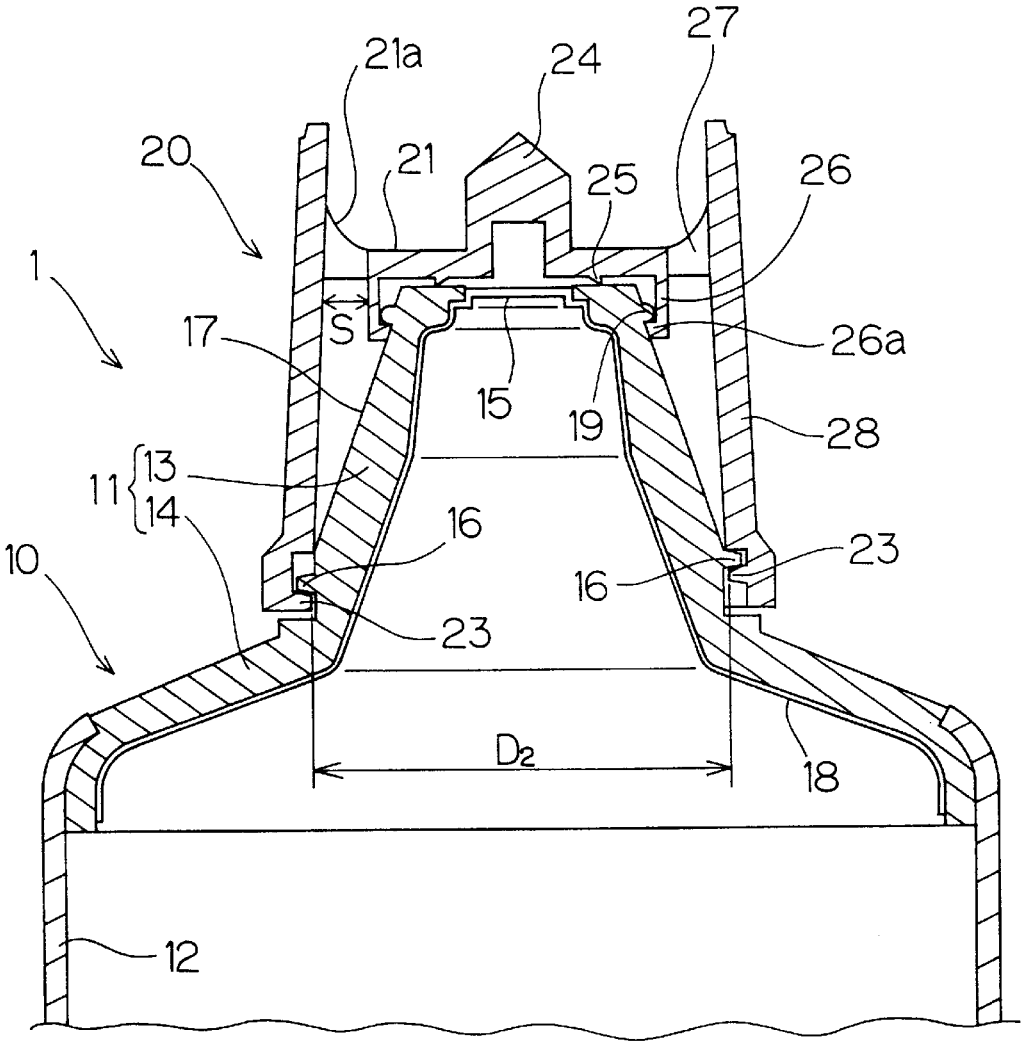
FIG. 2 is a longitudinal sectional view of the collapsible tube container shown in FIG. 1 when the cap has been fully screwed onto the container body.

Provided on the inner surface of the head piece 11 is a thin sealing member 18 which covers the surface portions of the head piece from the top end face of the neck 13 to the shoulder portion 14 in close contact, for the purpose of sealing the dispensing aperture 15 of the container as shown in FIG. 2. The sealing member 18 comprises an aluminum foil covered with synthetic resin layers on both sides and is made by, for example, dry-laminating a biaxially oriented polypropylene film having a thickness of 20 $\mu$m on one side of the aluminum foil having a thickness of 30 $\mu$m, coating the other side of the aluminum foil with modified polypropylene coating and drying the coating at a temperature of 200° C. to form a coating film of 40 mg/dm$^2$ in thickness.

After shaping the sealing member 18 to the profile of the inner surfaces of the head piece and setting the shaped sealing member inside a die for molding the head piece 11, a thermoplastic synthetic resin having relatively high heat resistance such as polypropylene is injected into the die to form the head piece 11. This process ensures that the sealing member 18 is seated in close contact with the inner surfaces of the head piece 11 (the process of shaping the sealing member 18 to a profile of the inner surface of the head piece is well known and it is preferable to employ the method disclosed in Japanese Patent Kokai (A) Publication No. 5-139452 (1993)).

The body wall portion 12 of the container body which is integrally connected to the bottom end of the head piece 11 is formed in a cylindrical shape, for example, by seam welding both side edges of a cylindrically rolled laminate sheet of aluminum foil and synthetic resin layers. The synthetic resin layers of the laminate sheet may comprise, for example, non-oriented polypropylene layer having a thickness of 30 μm, a printing layer, an urethane adhesive layer, a white polypropylene layer having a thickness of 60 μm, an extruded polypropylene layer having a thickness of 30 μm, a modified polypropylene adhesive layer having a thickness of 2 μm, aluminum foil having a thickness of 30 μm, a modified polypropylene adhesive layer having a thickness of 2 μm, an extruded polypropylene layer having a thickness of 30 μm and a propylene layer having a thickness of 100 μm, all laminated sequentially in this order.

The top end of the cylindrically formed body wall portion 12 and the bottom end (circumference of the shoulder portion 14) of the head piece 11 are welded integrally with each other by induction heating utilizing advantages of the aluminum foil used for both laminated sheet and the sealing member 18 on the inside of the head piece 11.

Though not shown in the drawing, the body wall portion 12 has an open bottom end (bottom of the container) which is pressed flat and heat sealed after the container is filled with a food product through the opening.

The container body 10 described above does not allow a gas to permeate and has an excellent flavor retention due to the aluminum foil barrier layer extending over the body wall portion 12, the shoulder portion 14, the neck 13 and the dispensing aperture 15.

A cap 20 being engaged threadably with the neck 13 of the container body 10 is formed integrally by injection molding a thermoplastic resin having relatively high heat resistance such as polypropylene in a manner similar to molding the head piece 11. The cap 20 has a top wall 21 covering the top end of the neck 13, a skirt 22 extending from the circumference of the top wall downwardly and upper extension 22*a* of the skirt 22 extending outwardly from the skirt 22 above the top wall 21.

Formed on lower portions of the inner surface of the circumferential wall 28 are a pair of ridges 23 each extending opposite to the other in a spaced relation along the circumference of the inner surface of the skirt. The ridges 23 function as threads for threadable engagement with the threads 16 of the neck 13.

Formed at the center of the top face of the top wall 21 is a dispensing aperture piercing pinnacle 24 for breaking the sealing member 18 of the dispensing aperture 15, protruding from the top wall 21 as an integral part thereof, to a height not greater than that of the upper extension 22*a*.

The top wall 21 is connected with the circumferential wall 28 at four points via bridge portions 21*a* and four arc-shaped openings 27 through the top wall 21 are provided between each two bridge portions. The greater the openings 27, the easier it is to drain water trapped in gap portions between the neck and the cap during a retorting process, but on the other hand greater openings essentially result in smaller bridge portions 21*a* with decreased strength. Thus the size of the openings 27 must be optimized by taking both case of draining and desired strength of the bridge portions into consideration.

Formed on a bottom face of the top wall 21 is an annular-shaped sealing ridge 25 protruding from the top wall 21 as an integral part thereof. The ridge 25 is pressed against an annular portions of the top surface of the neck 13 when the thread 16 of the neck 13 and the thread 23 of the cap 20 are fully engaged with each other, so that the sealing ridge 25 seals the dispensing aperture 15.

Formed on an upper circumference of the neck 13 near the top end thereof is engagement ridge 19 protruding outwardly as an integral part thereof, in the form of four discontinued ridges being disposed in an equally spaced relation in the circular direction of the circumference. An outer diameter $D_1$ of the engagement ridge 19 (see FIG. 1) is smaller than the inner diameter $D_2$ of the thread 23 of the cap 20 (see FIG. 2). This relation of $D_1 < D_2$ can be easily met as the outer surface 17 of the neck 13 is in a shape of truncated cone.

The engagement ridge 19 may also be formed in a continuous annular ridge running in the circular direction of the circumference of the neck 13. However, in order to minimize force required to engage or disengage with a below-mentioned engagement portion 26*a* of the cap 20, it is preferable to form two to six discontinued ridges, and particularly three to four ridges each extending in the direction of circumference in a range within angles from 30 to 50 degrees about the center of the dispensing aperture 15 are most desirable.

The engagement portion 26 protrudes from the bottom surface of the top wall 21 and is formed as an integral part thereof, at a distance S from the circumferential wall 28 as shown in FIG. 2. The engagement portion 26 has a cylindrical shape concentric with the sealing ridge 25. The engagement portion 26 has a cylindrical wall which is thinner than the circumferential wall 28.

The engagement portion 26 has an annular engaging hook 26*a* inwardly protruding from the open bottom end of engagement portion 26. When the thread 16 of the neck 13 and the thread 23 of the cap 20 are fully engaged, the engaging hook 26*a* comes into contact with the bottom surface of the engagement ridge 19 of the neck 13.

Figure 3:
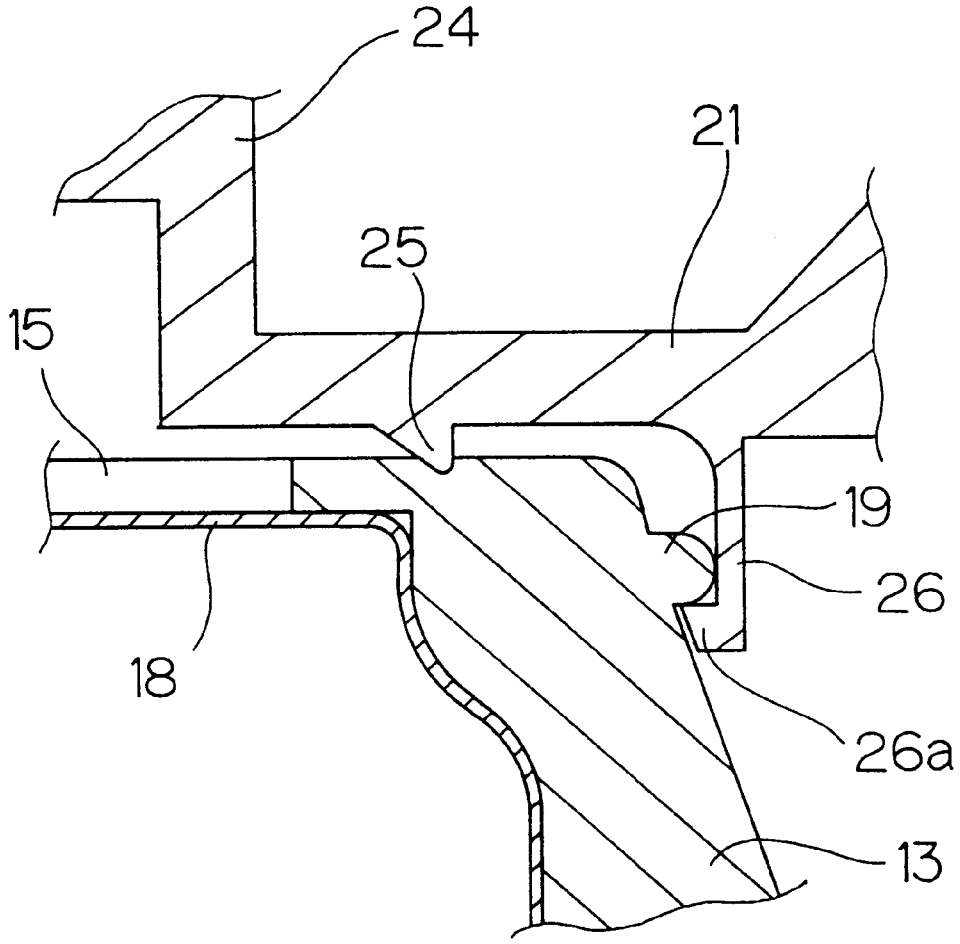
FIG. 3 is a partially enlarged longitudinal sectional view of the collapsible tube container shown in FIG. 2 where the cap has been fully screwed onto the container body.
Figure 4:
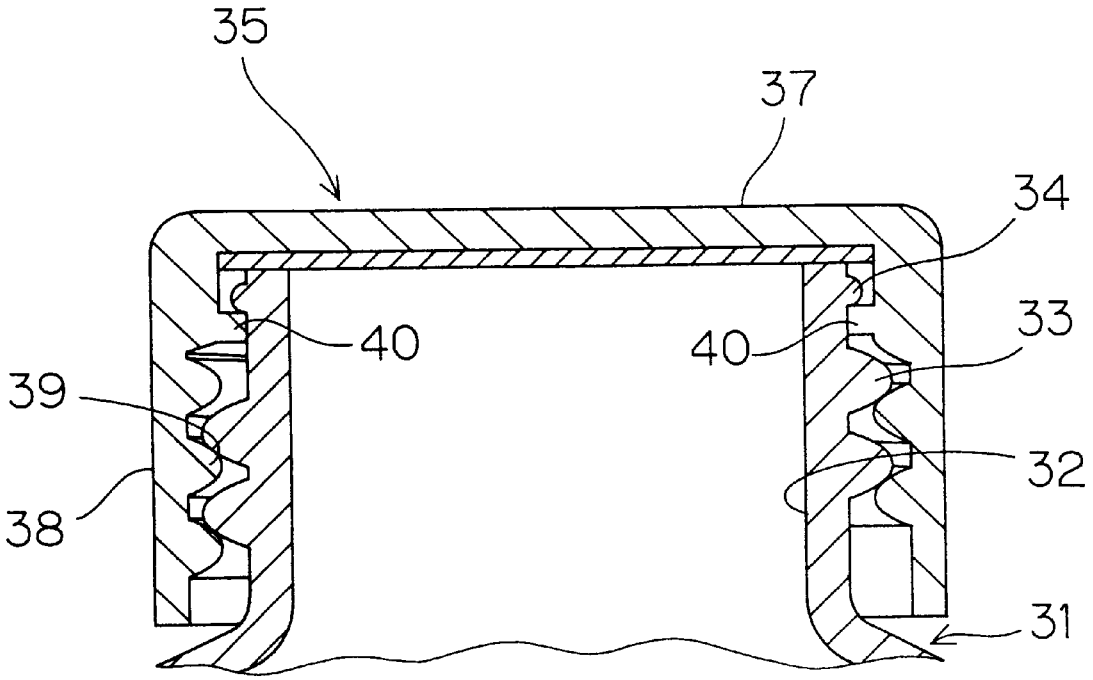
FIG. 4 is a sectional view showing the state of threadable engagement of the cap and the container body of the collapsible tube container employing the conventional anti-loosening mechanism.

According to the collapsible tube container 1 of the aforementioned construction, comprising the container body 10 and the cap 20, the engaging hook 26*a* of the engagement portion 26 of the cap 20 is pressed against the upper side of the engagement ridge 19 (four ridges) of the neck 13 as the cap 20 is screwed onto the neck 13 of the container body 10. Turning the cap 20 further causes the engagement portion 26 on the cap to deform a little outwardly while the engaging hook 26*a* which is pressed against the engagement ridge 19 is caused to deform a little upwardly, thereby to pass over the ridges, so that when the cap 20 has been fully screwed onto the container body 10, the engaging hook 26*a* stays engaged with the engagement ridge 19 (see FIG. 3).

As the cap 20 is unscrewed, the engaging hook 26*a* of the cap 20 is pressed against and resisted by the engagement ridge 19 (four ridges) of the neck 13. Turning the cap 20 further causes the engagement portion 26 of the cap to deform a little outwardly while the engaging hook 26*a* is pressed against the engagement ridge 19 caused to deform a little downwardly, so that the engaging hook 26*a* gets over the engagement ridge 19 on the neck 13 and the cap 20 is released from the neck 13.

When the thread 16 of the neck 13 of the container body and the thread 23 of the cap 20 are in complete engagement with each other, engagement of the engagement portion 26 of the cap 20 and the engagement ridge 19 of the neck 13 is maintained, and the engaging hook 26*a* protruding inwardly from the open bottom end of the engagement portion 26 of the cap 20 stays in contact with the lower side of the engagement ridge 19 of the neck 13. Therefore, even when both container body 10 and cap 20 are softened by heat during sterilization process in a retort chamber and a relative rotating force is exerted between the container body 10 and the cap 20, the threadable engagement of the neck 13 and the cap 20 may not be loosened.

Also according to this embodiment, because the engagement portion 26 of the cap 20 is thinner than the circumferential wall 28 and the engaging hook 26*a* is formed on the bottom end (open end) of the engagement portion 26, outward deformation of the engagement portion 26 coinciding with the upward deformation of the engaging hook 26*a* can easily occur, so that the engaging hook 26*a* may be moved over the engagement ridge 19 by less force than what is required for operating the conventional anti-loosening mechanism as disclosed, for example, in Japanese Utility Model Kokai (A) Publication No. 55-117952 (1980). Therefore, excessive force may not be exerted to the thread 16 of the neck 13 or the thread 23 of the cap 20 to accelerate wearing of the threads.

Also as the engagement portion 26 and the circumferential wall 28 are spaced apart from each other by distance 5, may not adversely affect the circumferential wall 28, or the engagement portion 26 does not come in contact with the circumferential wall 28. Therefore, repetitive screwing and removing operations of the cap 20 may not cause permanent deformation of the thread 23 at the bottom end of the circumferential wall 28 or looseness of the threadable engagement of the cap 20 and the neck 13.

Also, secure threadable engagement of the container body 10 and the cap 20 can be maintained the short thread 16 provided near the bottom end of the neck 13 of the container body, as the engagement ridge 19 of the neck 13 engages with hook 26*a* of the cap 20. Also as the outer surface portion 17 of the neck 13 extending below the dispensing aperture 15 in a truncated corn is smooth and free from any thread, uneasy feeling of threads is not given to the consumers when the consumers apply their lips to the neck 13 of the container body 10 and take a product out of the container through the dispensing aperture 15, and the product may not remain on the circumferential surface 17 of the neck 13.

Also, as the outer surface 17 of the neck 13 is formed in a shape of a truncated cone, the outer diameter $D_1$ of the engagement ridge 19 which is formed on the circumference of the neck 13 of the container body near the upper end thereof can readily be made smaller than the inner diameter $D_2$ of the thread 23 of the cap 20, so that the operation of screwing the cap 20 onto the neck 13 of the container body is not disturbed by the engagement ridge 19 of the neck 13. Moreover, the container can be easily capped because the outer surface 17 of the neck 13 guides the cap 20.

Further in this embodiment, because the engagement ridge 19 of the neck 13 comprises four discontinued ridges formed movement of the engaging hook 26*a* of the cap 20 to pass over the engagement ridge 19 of the neck 13 when the cap 20 is screwed onto the neck 13 causes a slight upward deformation of only those portions of the engaging hook 26*a* of the cap 20 that come in contact with the discontinued ridges and the remaining portions of the engagement hook pass the engagement ridge without deforming upwardly. Consequently, the engagement ridge 19 may be passed over by less force as compared to what is required when the entire circumference of the engaging hook 26*a* is deformed by, for example, the engagement ridge 10 of a continuous annular shape.

Also in this embodiment, both thread 16 formed on the neck 13 of the container body and thread 23 formed on the circumferential wall 28 of the cap 20 are arranged in a spaced relation along the circumference in a plurality of inclined ridges, and therefore the cap 20 can be screwed and removed from the neck 13 by a minimum of turns.

Also according to this embodiment, the top wall 21 of the cap 20 is connected with the circumferential wall 28 by four bridge portions 21*a* and openings 27 through the top wall 21 are dispensed between each to bridge portions, so that water trapped in the gap portions between the neck 13 and the cap 20 during a retorting process can be easily drained and the gap portions can quickly get dry by drafts through the openings 27. Thus, the food product in collapsible tube container 1 does not give unfavorable impression of insanitation to the consumers who purchase it.

An embodiment of the retortable container of the present invention has been described above, but it should be appreciated that the present invention is not limited to this embodiment.

For example, the engagement portion 26 of the cap 20 is not limited by the continuous cylindrical shape as in the above embodiment, and may be formed in intermittent configuration including discontinuity. The present invention is applicable to any retortable container having a cap screwed onto a neck of the container body, and applicability thereof is not limited to collapsible tube containers.

We claim:

1. A retortable container comprising a container body having a neck made of a thermoplastic synthetic resin whereon a constantly inclined thread is formed, and a cap made of a thermoplastic synthetic resin, the cap having a circumferential wall whereon a constantly inclined thread is formed for threadable engagement with the neck, wherein the neck has an engagement ridge having an outer diameter $D_1$ smaller than an inner diameter $D_2$ of the thread on the cap, said engagement ridge being formed on a circumferential surface of the neck near a top end where a dispensing aperture is provided; and the cap has an integral engagement portion extending from a bottom surface of a top wall thereof, said integral engagement portion having an engaging hook, spaced inwardly from the circumferential wall, for engaging with the engagement ridge of the neck when the thread on the neck and the thread on the cap are completely engaged with each other.

2. The retortable container according to claim 1, wherein the thread on the neck is formed at a lower end of the circumferential surface of the neck and the circumferential surface between the top face of the neck and the lower end thereof has a shape of a truncated cone.

3. The retortable container according to claim 1, wherein the thread formed on the neck of the container body and the thread formed on the cap are both formed by a plurality of inclined ridges disposed in an equally spaced relation.

4. A retortable container comprising a container body having a neck made of a thermoplastic synthetic resin whereon a thread is formed, and a cap made of a thermoplastic synthetic resin whereon a thread is formed for threadable engagement with the neck, wherein a top wall of the cap is rigidly connected with a circumferential wall of said cap via bridge portions, spaced by openings through the top wall between bridge portions.

5. A retortable container comprising a container body having a neck made of a thermoplastic synthetic resin whereon a thread is formed, and a cap made of a thermoplastic synthetic resin, the cap having a circumferential wall whereon a thread is formed for threadable engagement with the neck, wherein the neck has an engagement ridge having an outer diameter $D_1$ smaller than an inner diameter $D_2$ of the thread on the cap, said engagement ridge being formed on a circumferential surface of the neck near a top end where a dispensing aperture is provided; and the cap has an integral engagement portion extending from a bottom surface of a top wall thereof, said integral engagement portion having an engaging hook for engaging with the engagement ridge of the neck when the thread on the neck and the thread on the cap are completely engaged with each other, the engagement portion being a cylindrical wall thinner than the circumferential wall of the cap, and the engaging hook being annular in shape and protruding radially inwardly from an open bottom end of the cylindrical wall.

6. The retortable container according to claim 5, wherein the engagement ridge of the neck is formed by a plurality of discontinued ridges arranged in line annularly about a circumferential surface of the neck.

7. A retortable container comprising a container body having a neck made of a thermoplastic synthetic resin whereon a thread is formed, and a cap made of a thermoplastic synthetic resin, the cap having a circumferential wall whereon a thread is formed for threadable engagement with the neck, wherein the neck has an engagement ridge having an outer diameter $D_1$ smaller than an inner diameter $D_2$ of the thread on the cap, said engagement ridge being formed on a circumferential surface of the neck near a top end where a dispensing aperture is provided; and the cap has an integral engagement portion extending from a bottom surface of a top wall thereof, said integral engagement portion having an engaging hook for engaging with the engagement ridge of the neck when the thread on the neck and the thread on the cap are completely engaged with each other, the top wall of the cap being connected with the circumferential wall via bridge portions spaced by openings through the top wall and between bridge portions.

* * * * *